US006830245B2

(12) United States Patent
Matsushima et al.

(10) Patent No.: US 6,830,245 B2
(45) Date of Patent: Dec. 14, 2004

(54) SHEET CONTAINING DEVICE AND SHEET FEEDER HAVING THE SAME, AND IMAGE FORMING APPARATUS

(75) Inventors: Akira Matsushima, Shizuoka (JP); Yasuhiro Uchida, Shizuoka (JP); Makoto Izumi, Shizuoka (JP); Minoru Kawanishi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/227,948

(22) Filed: Aug. 27, 2002

(65) Prior Publication Data

US 2003/0057634 A1 Mar. 27, 2003

(30) Foreign Application Priority Data

Aug. 31, 2001 (JP) ..... 2001-265083

(51) Int. Cl.[7] ..... B65H 1/00
(52) U.S. Cl. ..... 271/171; 271/223
(58) Field of Search ..... 271/152, 155, 271/154, 157, 171, 162

(56) References Cited

U.S. PATENT DOCUMENTS 4,030,725 A * 6/1977 Fukui et al. ..... 271/164
4,786,042 A * 11/1988 Stemmle ..... 271/9.1
5,029,841 A * 7/1991 Ettischer et al. ..... 271/171
5,297,787 A * 3/1994 Shirai ..... 271/171
5,305,332 A 4/1994 Ozawa ..... 371/31
5,765,826 A 6/1998 Isoda et al. ..... 271/162
6,254,086 B1 7/2001 Sunou et al. ..... 371/171

FOREIGN PATENT DOCUMENTS

| | | |
|---|---|---|
| JP | 3-102015 | 4/1991 |
| JP | 8-239129 | 9/1996 |
| JP | 11-292305 | 10/1999 |
| JP | 2000-34022 | 2/2000 |
| JP | 2000-309431 | 11/2000 |
| JP | 2001-80751 | 3/2001 |
| JP | 2002-211770 | 7/2002 |

* cited by examiner

*Primary Examiner*—Donald P. Walsh
*Assistant Examiner*—Kaitlin Joerger
(74) *Attorney, Agent, or Firm*—Fitzpatrick, Cella, Harper & Scinto

(57) ABSTRACT

A sheet containing device including a device frame, a sheet stacking portion that is provided in the device frame and supports sheets, an end regulating portion that abuts against an end of sheets stacked on the sheet stacking portion to perform positional regulation of the sheets, a hitting member that is arranged between the device frame and the end regulating member and moves in accordance with the movement of the end regulating member, and an abutting member for abutting the hitting member in a position to which the hitting member moves, in which deflection of the end regulating member is restricted by the device frame through the hitting member and the abutting member.

13 Claims, 13 Drawing Sheets

SHEET CONTAINING DEVICE AND SHEET FEEDER HAVING THE SAME, AND IMAGE FORMING APPARATUS

BACKGROUND OF THE INVENTION

1. Field of the Invention

The present invention relates to a sheet containing device and a sheet feeder having the same, and an image forming apparatus having the sheet feeder, and in particular to a sheet containing device having an end regulating member for regulating movement of sheets stacked on a sheet stacking means.

2. Related Background Art

Conventionally, in an image forming apparatus such as a copying machine, a printer, a facsimile machine and a composite apparatus thereof, a sheet feeder for feeding sheets contained in a sheet containing device to an image forming portion is provided.

Here, as this sheet containing device, there is one having sheet stacking means for staking sheets, a side regulating member for moving in a direction (hereinafter referred to as a cross direction) perpendicular to a sheet feeding direction to regulate side ends of a sheet and a trailing end regulating member for abutting a trailing end of a sheet on the opposite side of the sheet feeding direction to regulate a position in the sheet feeding direction of the sheet. The sheet containing device moves the side regulating member and the trailing end regulating member to predetermined positions, respectively, according to a size of a sheet, thereby performing positioning and movement regulation of the sheet.

Incidentally, as a method of positioning such a side regulating member, there are known an insertion system that inserts the side regulating member in insertion holes formed in predetermined positions on a bottom surface of a sheet containing device main body and a slide system that provides respectively rack portions in side regulating members arranged so as to be opposed to each other and causes the side regulating members to slide in association with the rack portions via gears engaging with the rack portions.

However, in the conventional sheet containing device having such a side regulating member, if positioning of the side regulating member is performed by the insertion system, it is difficult to form insertion holes because positions for forming the insertion holes are in close proximity to each other, for example, in a sheet containing device in which letter size (LTR-sized) sheets and A4 size sheets, which have a small dimensional difference in the cross direction, are contained. In addition, if a sheet size is changed, the side regulating member has to be removed from the insertion holes once and then inserted in predetermined positions again, which is extremely laborious.

On the other hand, if the slide system is used, since a position of the side regulating member can be changed simply by sliding the side regulating member, positioning can be performed easily.

However, in the slide system, since the rack portions of the side regulating member arranged so as to be opposed to each other are arranged below the sheet stacking means, deflection tends to occur in an abutting portion of the side regulating member that abuts against a sheet. Thus, when a sheet stack is inserted, the abutting portion of the side regulating member may be pressed by the sheet stack and deflected. Then, it is difficult to perform accurate positioning of the sheet stack in the upper part of the side regulating member if the abutting portion is deflected in this manner.

SUMMARY OF THE INVENTION

The present invention has been devised in view of such present conditions, and therefore it is an object of the present invention to provide a sheet containing device in which positioning of a regulating member is easy and accurate and positioning of stacked sheets is possible, and a sheet feeder and an image forming apparatus that have the sheet containing device.

According to the present invention, there is provided a sheet containing device including: a device main body frame; sheet stacking means that is provided within the device main body frame and supports sheets; end regulating means that abuts an end of sheets stacked on the sheet stacking means to perform positional regulation of the sheets; hitting means that is arranged between the device main body frame and the end regulating means and moves in accordance with the movement of the end regulating means; and abutting means for abutting against the hitting means in a position to which the hitting means moves, in which deflection of the end regulating means is regulated by the device main body frame via the hitting means and the abutting means.

According to the present invention, there is provided a sheet containing device including: a sheet stacking table for supporting a sheet; a side regulating member that is movable in a cross direction of the sheet perpendicular to a sheet feeding direction of the sheet stacked on the sheet stacking table and abuts against a side end of the sheets stacked on the sheet stacking table to perform positional regulation in the cross direction of the sheet; a hitting member that hits against a back surface on the opposite side of a sheet abutting surface of the side regulating member and regulates deflection to the back surface side of the side regulating member; a connecting member that moves the hitting member in a direction perpendicular to a moving direction of the side regulating member in association with a moving operation of the side regulating member; and an abutting portion that is provided on the back surface of the side regulating member and is formed in a shape for abutting against the hitting member moved by the connecting member in a position to which the side regulating member moves to regulate the sheet.

DESCRIPTION OF THE PREFERRED EMBODIMENTS

Embodiments of the present invention will be hereinafter described with reference to the accompanying drawings.

Figure 1:
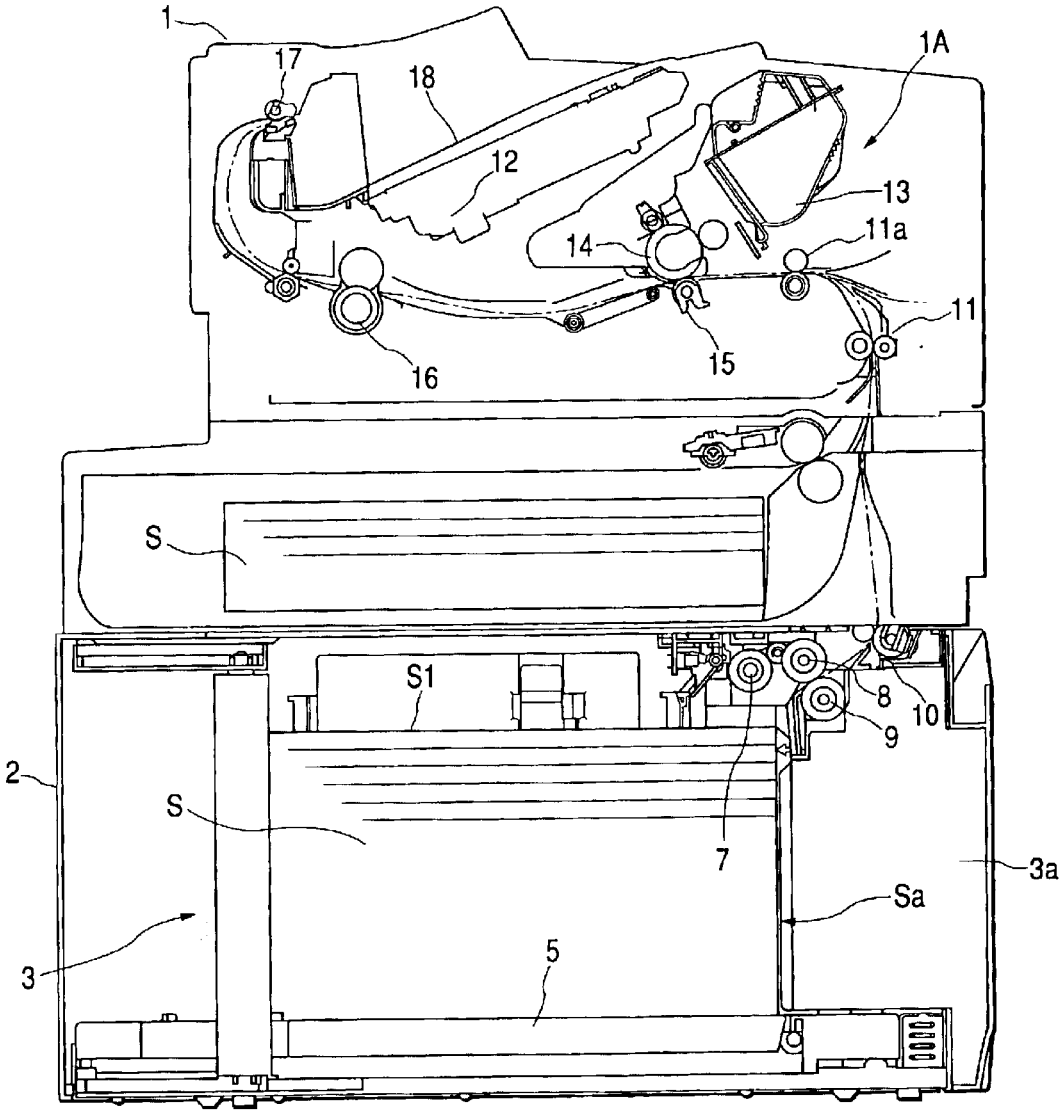
FIG. 1 is a view showing a schematic structure of an image forming apparatus having a deck type sheet feeder that is an example of a sheet feeder in accordance with a first embodiment of the present invention.

FIG. 1 is a view showing a schematic structure of an image forming apparatus having a deck type sheet feeder that is an example of a sheet feeder in accordance with a first embodiment of the present invention.

In FIG. 1, reference numeral 1 denotes an image forming apparatus main body and reference numeral 2 denotes a deck type sheet feeder (hereafter referred to as a feed deck) attached to the image forming apparatus main body 1. In addition, reference numeral 1A denotes an image forming portion that is provided in the image forming apparatus main body 1 and performs image formation by an electrophotographic system. This image forming portion 1A has a photosensitive drum 14 for forming a toner image, a laser scanner 12 for irradiating light modulated according to an image signal on the photosensitive drum 14, a transfer roller 15 for transferring a toner image formed on the photosensitive drum 14 to a sheet S, and so on.

Then, when an image forming operation is started in the image forming portion 1A having such a structure, first, light modulated according to an image signal is irradiated on the photosensitive drum 14 by the laser scanner 12, whereby a latent image is formed on the photosensitive drum 14. Next, this latent image is developed with toner contained in a toner cartridge 13, whereby a toner image (visible image) is formed on the photosensitive drum 14.

When a sheet S is fed from the feed deck 2 in a manner to be described later simultaneously with such a toner image forming operation, this sheet S is transported to a transferring portion, which is constituted of the photosensitive drum 14 and the transfer roller 15, by a transport roller 11 and a registration roller 11A in synchronism with the toner image formed on the photosensitive drum 14. Then, in this transferring portion, the toner image is transferred to the sheet S by applying a bias to the transfer roller 15.

Further, the sheet S having the toner image transferred thereon in this manner is thereafter transported to fixing means 16 and heated in this fixing means 16, whereby the toner image is fixed on the sheet S. Moreover, thereafter, the sheet S is delivered to a delivery portion 18 in the upper part of the apparatus by a delivery roller 17.

Incidentally, as shown in FIG. 1, the feed deck 2 comprises: a sheet containing device 3 provided with a sheet stacking table 5 functioning as sheet stacking means for stacking a sheet stack Sa and capable of lifting and lowering in a sheet storage 3*a* for containing sheets S, and provided with regulating members 19, 20 and 21 discussed later; sheet feeding means including a feed roller 7 that feeds out an uppermost sheet S1 of the sheet stack Sa stacked on the sheet stacking table 5 and a separating roller pair 8, 9 that is constituted of a feed roller 8 and a retard roller 9 and separates sheets S fed by the feed roller 7; and a transport roller 10 for transporting the sheet S separated and fed individually by the separating roller pair 8 and 9 to the image forming apparatus main body 1.

Figure 2:
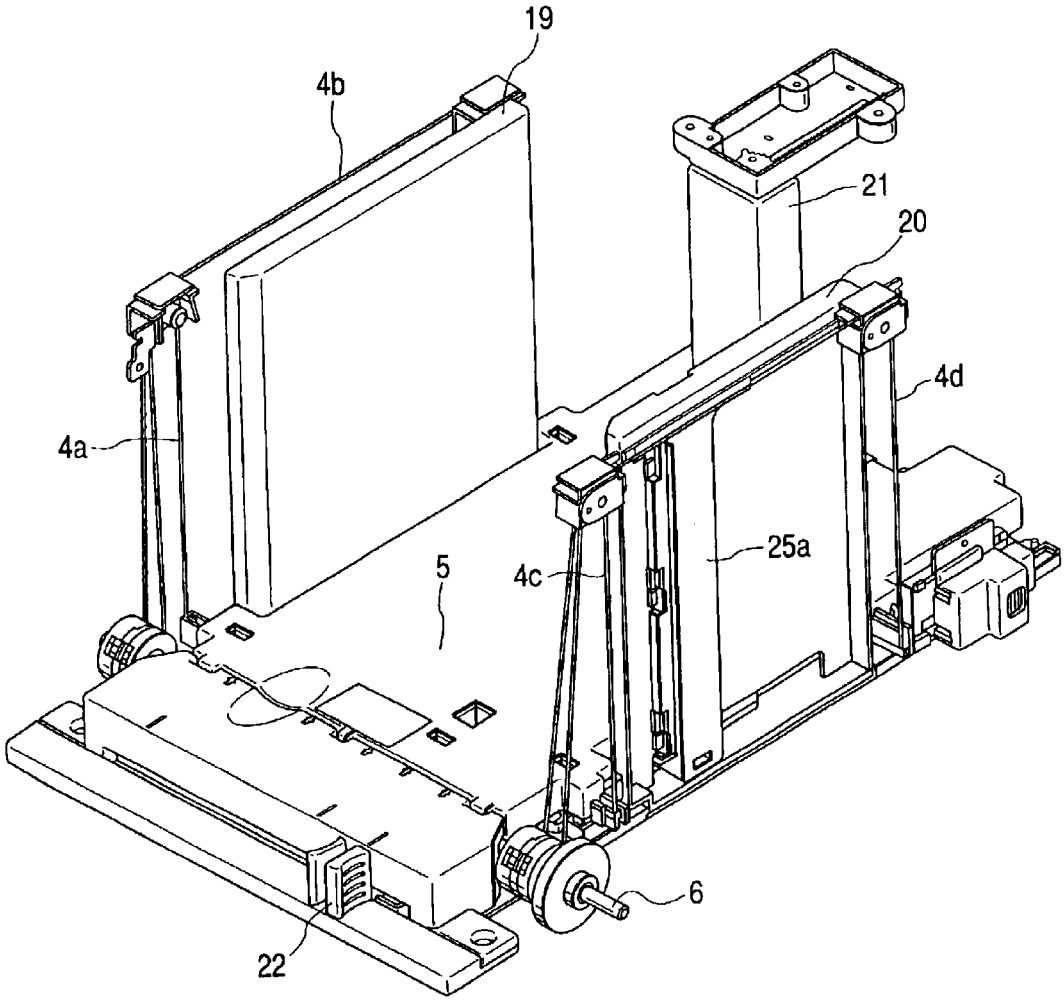
FIG. 2 is a perspective view showing a structure of a sheet containing device provided in the sheet feeder (feed deck) shown in FIG. 1.

Further, the sheet stacking table 5 is suspended by wires 4*a*, 4*b*, 4*c* and 4*d* as shown in FIG. 2. The sheet stacking table 5 moves in the vertical direction (ascends and descends) by winding the wires 4*a*, 4*b*, 4*c* and 4*d* around a wire winding shaft 6 by a driving force of driving means (not shown) such as a motor and unwinding the wires 4*a*, 4*b*, 4*c* and 4*d*.

Figure 3:
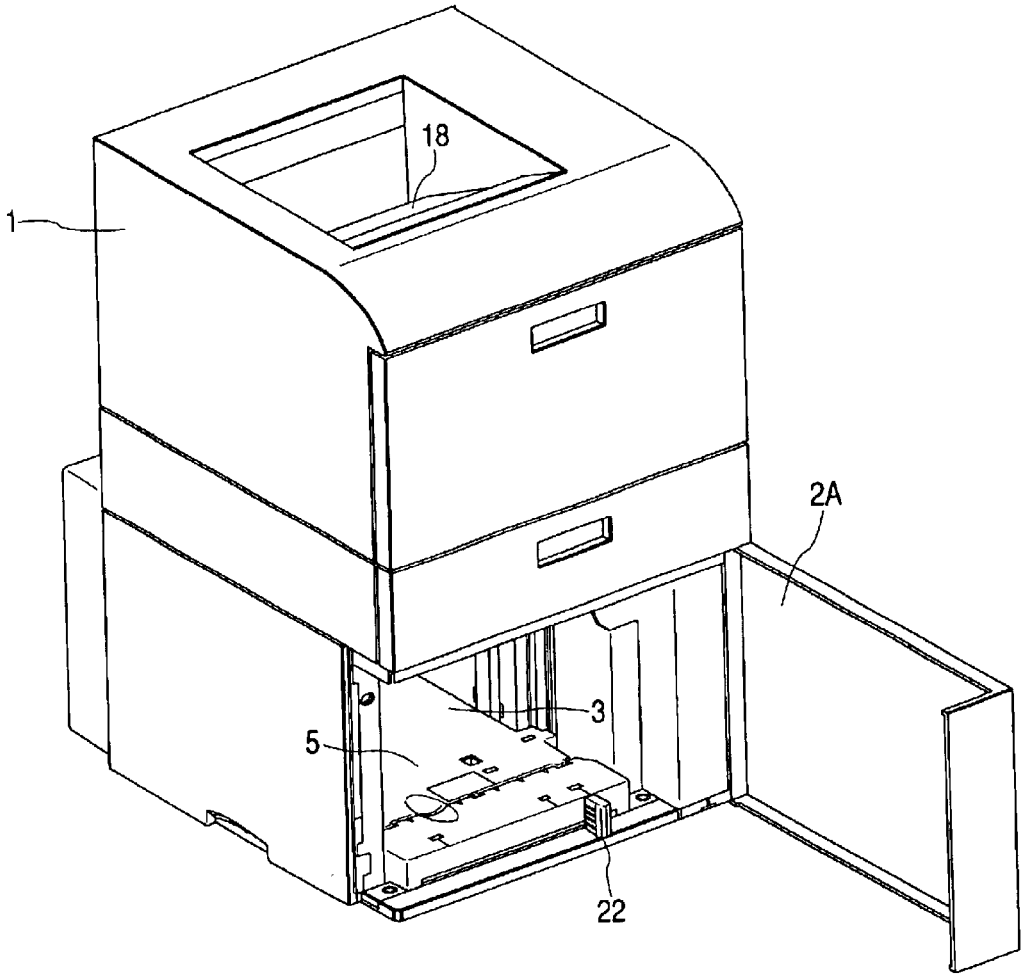
FIG. 3 is a perspective view of the image forming apparatus showing a state in which a door of the sheet feeder shown in FIG. 1 is open.

Moreover, the feed deck 2 has an openable and closable door 2A that is opened when the sheet stack Sa is stacked on the sheet stacking table 5 as shown in FIG. 3. Then, when the door 2A is opened as shown in FIG. 3, in this embodiment, the wire winding shaft 6 is rotated in a forward direction by a control portion (not shown) that has detected that the door 2A is open. The wires 4*a*, 4*b*, 4*c* and 4*d* are unwound by the rotation, and the sheet stacking table 5 descends to a lowermost position as shown in FIG. 3.

Figure 4:
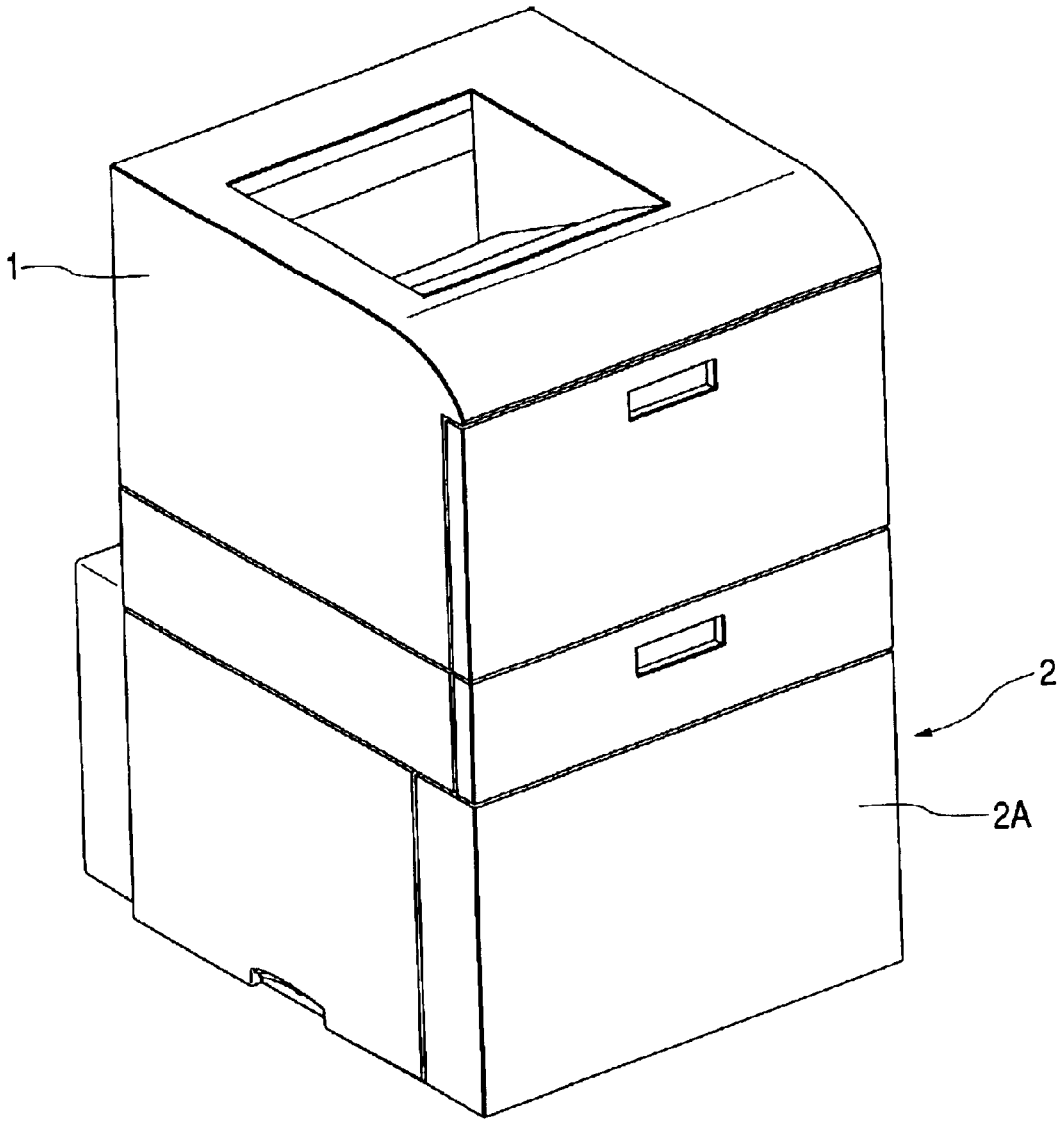
FIG. 4 is a perspective view of the image forming apparatus showing a state in which the door of the sheet feeder shown in FIG. 1 is closed.

When the stacking of the sheet stack Sa on the sheet stacking table 5 is completed and the door 2A is closed as shown in FIG. 4, the wire winding shaft 6 is rotated in a backward direction by the control portion (not shown) that has detected that the door 2A is closed. The wires 4*a*, 4*b*, 4*c* and 4*d* are wound by the rotation, and the sheet stacking table 5 ascends.

Then, thereafter, the motor (not shown) is controlled by the control portion to wind the wires 4*a*, 4*b*, 4*c* and 4*d* appropriately so as to keep a height of the sheet stacking table 5 at a predetermined position based on a signal from sheet surface detecting means (not shown). This predetermined position is a position where the uppermost sheet S1 of the stacked sheet stack Sa can be fed by the feed roller 7 and enter a nip of the separating roller pair 8 and 9 smoothly.

In FIG. 2, reference numeral 19 denotes a reference-side side regulating member functioning as a side regulating member for regulating movement of the sheet S on the sheet stacking table 5 in a cross direction (direction perpendicular to a feeding direction of sheets) and reference numeral 20 denotes a non-reference-side side regulating member. A position in the cross direction of the sheet S on the sheet stacking table 5 is regulated by the reference-side side regulating member 19 and the non-reference-side side regulating member 20 that are provided so as to be opposed to each other on the sheet stacking table 5. Further, a push-aside plate 20*b* (shown in FIGS. 5 and 6A to 6C) is provided in the non-reference-side side regulating member 20. The push-aside plate 20*b* is constituted so as to push stacked sheets to the reference-side regulating member 19 by a spring functioning as an elastic member.

In addition, reference numeral 21 denotes a trailing end regulating member that is provided on an inner side in a direction of containing sheets and regulates a trailing end of a sheet stack. Moreover, reference numeral 22 denotes an operation lever. When a user moves this operation lever 22, the side regulating members 19 and 20 and the trailing end regulating member 21 move in association with this operation lever 22, whereby it is possible to change a size of sheets that can be stacked. Note that, in this embodiment, three types of sheets, namely, LTR (279.4 mm×216 mm), A4 (297 mm×210 mm) and LGL (355.6 mm×216 mm), are stacked on the sheet staking table 5. Further, the reference-side side regulating member 19 can be provided in a position in the cross direction of a sheet that is the same as a position for transferring an image to the sheet in the cross direction of the sheet in the image forming portion 1A. The image can be transferred to an accurate position by delivering the sheet along the reference-side side regulating member 19.

Figure 5:
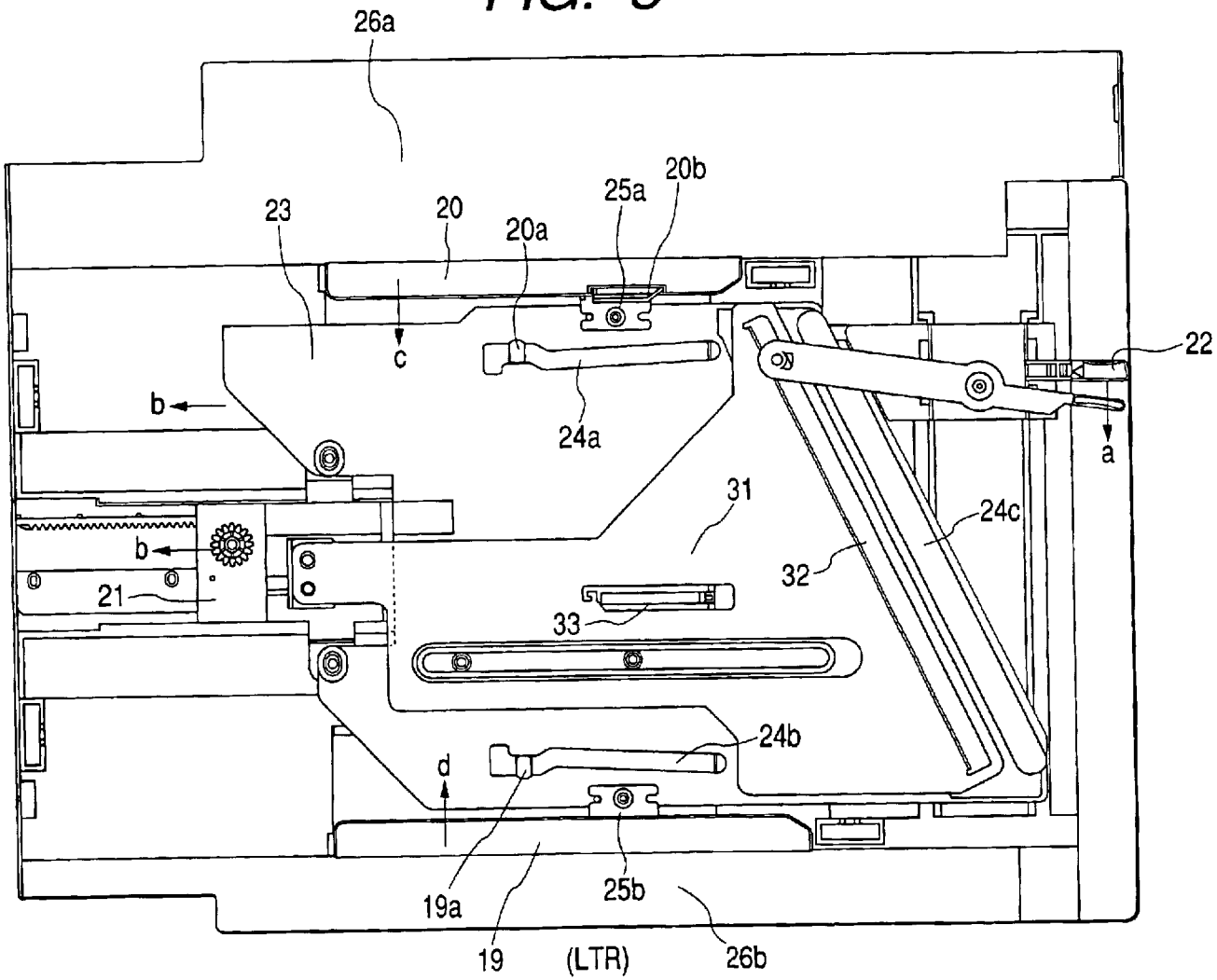
FIG. 5 is a bottom view of the sheet containing device shown in FIG. 1.

FIG. 5 is a view showing a mechanism for operating each of the regulating members 19, 20 and 21 that is provided under the sheet stacking table 5.

In FIG. 5, reference numeral 23 denotes a board member functioning as a connecting member. This board member 23 is in engagement with the operation lever 22 via a slit portion 24*c* formed diagonally. When the operation lever 22 is moved, for example, in a direction indicated by the arrow "a" in FIG. 5 by this slit portion 24*c*, the board member 23 moves in a direction indicated by the arrow "b", which is a direction perpendicular to a moving direction of the operation lever 22 (see FIG. 7B).

Here, the trailing end regulating member 21 is connected to the board member 23. When the board member 23 moves in the direction indicated by the arrow "b" in accordance with the operation of the operation lever 22 as described above, the trailing end regulating member 21 moves in the direction indicated by the arrow "b" (direction opposite to the sheet feeding direction) along a slit (not shown) in association with the movement of the board member 23.

The reference-side side regulating member 19 and the non-reference-side side regulating member 20 are provided to move in directions indicated by the arrows "c" and "d", which are perpendicular to the direction indicated by the arrow "b", by a sliding mechanism (not shown).

Slit portions 24*a* and 24*b* that engage with the non-reference-side side regulating member 20 and the reference-side side regulating member 19 are provided in the board member 23. Sliding portions 19*a* and 20*a* provided in the reference-side side regulating member 19 and the non-reference-side regulating member 20, respectively, are in engagement with the slit portions 24*a* and 24*b*. Consequently, when the board member 23 moves, the two side regulating members 19 and 20, which are provided so as to be opposed to each other to match the shape of these slit portions 24*a* and 24*b*, move symmetrically in the directions indicated by the arrows "c" and "d" in FIG. 5.

As described above, when the operation lever 22 is operated, the trailing end regulating member 21 and the two side regulating members 19 and 20 move, respectively. Consequently, positioning of the two side regulating members 19 and 20 can be performed easily.

Moreover, arm members 25*a* and 25*b* as hitting means, which are placed between the two side regulating members 19 and 20 and device frames 26*a* and 26*b* of the feed deck 2, are provided in this board member 23. The arm members 25*a* and 25*b* functioning as hitting members are constituted so as to move between the two side regulating members 19 and 20 and the device frames 26*a* and 26*b*, which constitute a feed deck main body, in sliding contact with the device frames 26*a* and 26*b* when the board member 23 moves.

Figure 6A:
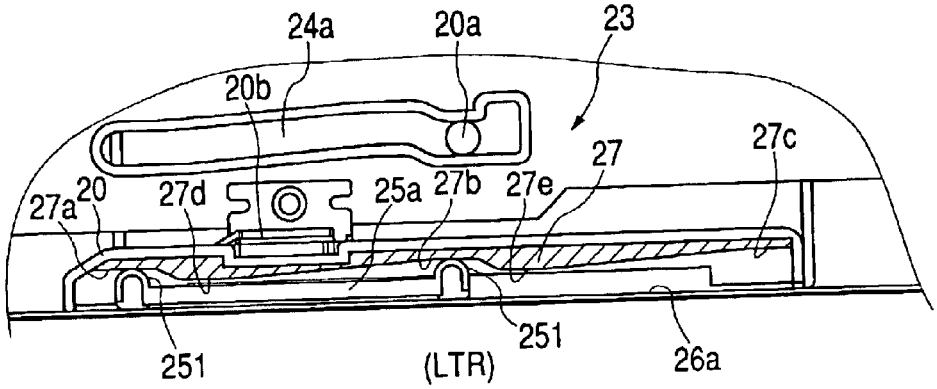
FIGS. 6A, 6B and 6C are main part sectional views showing states at the time of changing a sheet size of the sheet containing device shown in FIG. 1.
Figure 6B:
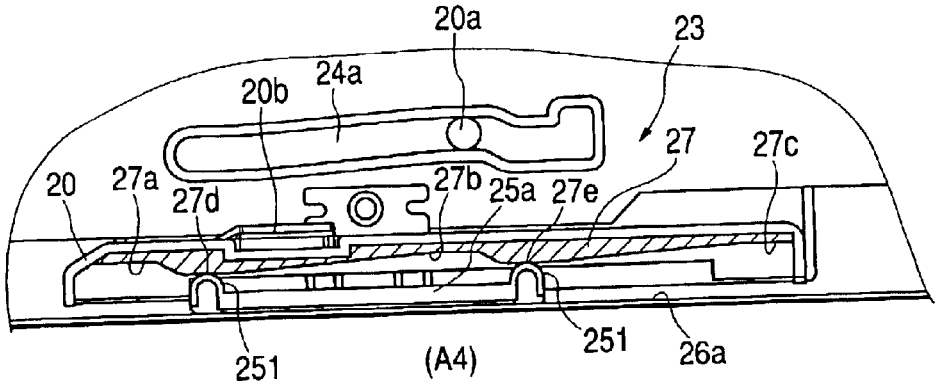
Figure 6C:
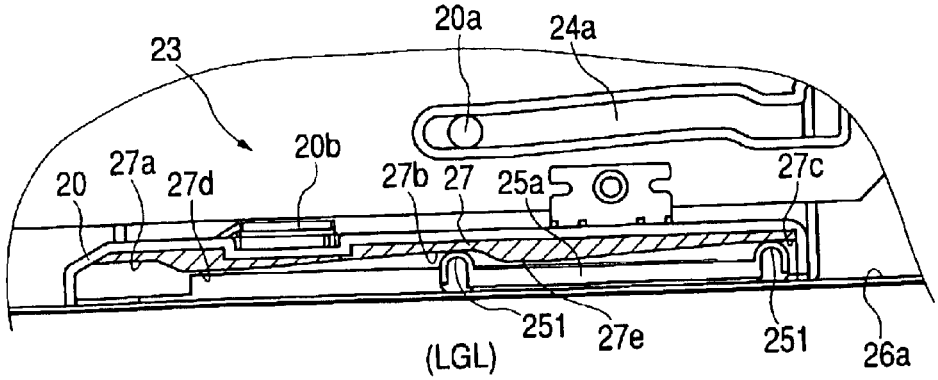

Further, a rib 27 constituting abutting means (abutting portion) for abutting against a projection 251 provided in the arm member 25*a* as shown in FIGS. 6A, 6B and 6C is provided in the upper part on the back surface of the non-reference-side side regulating member 20 that is the opposite side of a sheet abutting surface thereof that abuts against a sheet stack. Note that, although not illustrated, the arm member 25*b* is formed in the same shape as the arm member 25*a*, and a rib that is the same as the rib 27 is provided in the upper part on the back surface of the reference-side side regulating member 19.

In this rib 27, flat portions 27*a* and 27*b* are formed which abut against the projection 251 of the arm member 25*a* in the case in which a sheet of the LTR size shown in FIG. 6A is regulated, stepped portions 27*d* and 27*e* are formed which abut against the projection 251 in the case in which a sheet of the A4 size shown in FIG. 6B is regulated, and flat portions 27*b* and 27*c* are formed which abut against the projection 251 in the case in which a sheet of the LGL size shown in FIG. 6C is regulated. A distance between the flat portions 27*a*, 27*b* and 27*c* and the stepped portions 27*d* and 27*e* is set at 3 mm. In addition, the flat portions 27*a*, 27*b* and 27*c* are smoothly connected by slopes.

Here, for example, when the non-reference-side side regulating member 20 moves with the reference-side side regulating member 19 from a position for regulating a sheet of the LTR size shown in FIG. 6A to a position for regulating a sheet of the A4 size shown in FIG. 6B in association with movement of the board member 23, the projection 251 of the arm member 25*a* that has moved with the board member 23 abuts against the stepped portions 27*d* and 27*e* of the rib 27.

Then, when the non-reference-side side regulating member 20 moves to the position for regulating a sheet of the A4 size shown in FIG. 6B, the arm member 25*a*, which has moved with the board member 23 in a direction perpendicular to the moving direction of the side regulating member 20, and the rib 27 abut against each other, whereby the two side regulating member 20 are supported from their back side by the arm member 25*a*, respectively. In addition, since the arm member 25*a* is in sliding contact with the device frame 26*a*, the side regulating member 20 is securely supported by the device frame 26*a* via the arm member 25*a*. The reference-side side regulating member 19 is constituted in the same manner.

Consequently, regardless of a size of a sheet, the two side regulating members 19 and 20 do not deflected toward their back surface side any more even if a large volume of sheets are stacked. As a result, accurate positioning of a sheet stack can be performed in the upper part of the two side regulating members 19 and 20.

Next, operations of the three regulating members 19, 20 and 21 and the arm members 25*a* and 25*b* in changing stacked sheets will be described. Here, operations for changing sheets from the LTR size to the A4 size and the LGL size will be described.

FIG. 5, which has already been described, shows the positions of the three regulating members 19, 20 and 21 at the time when sheets of the LTR size are stacked. Note that, in this embodiment, a distance from a sheet feeding position to the trailing end regulating member 21 is set at approximately 279.4 mm and a distance between the side regulating members is set at approximately 216 mm in this case.

Figure 7A:
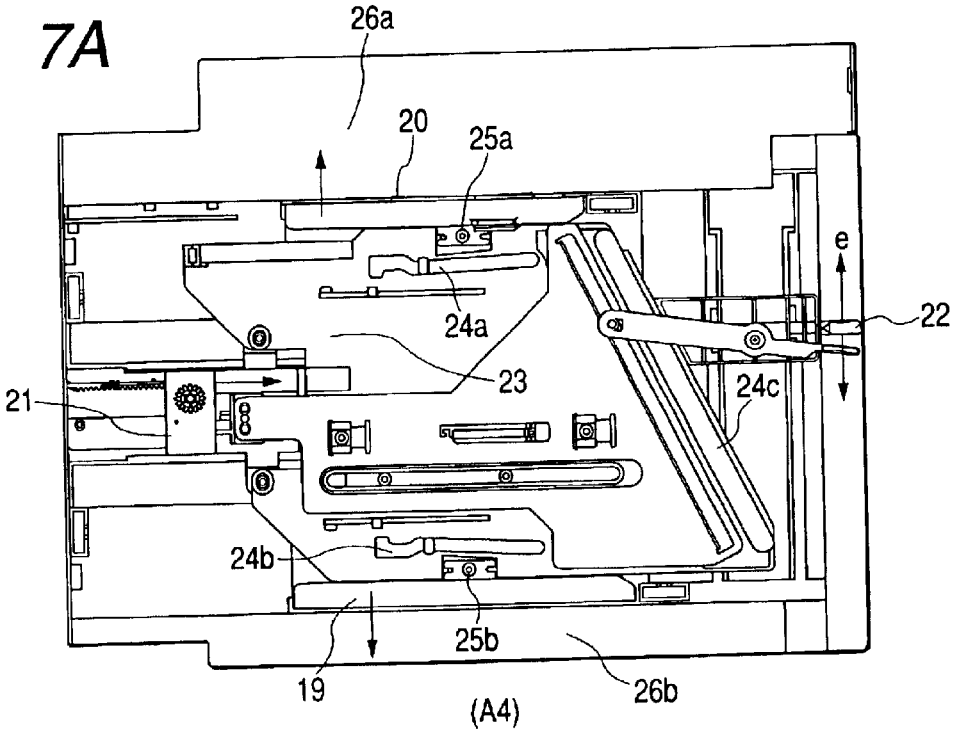
FIGS. 7A and 7B are bottom views showing states at the time of changing a sheet size of the sheet containing device shown in FIG. 1.
Figure 7B:
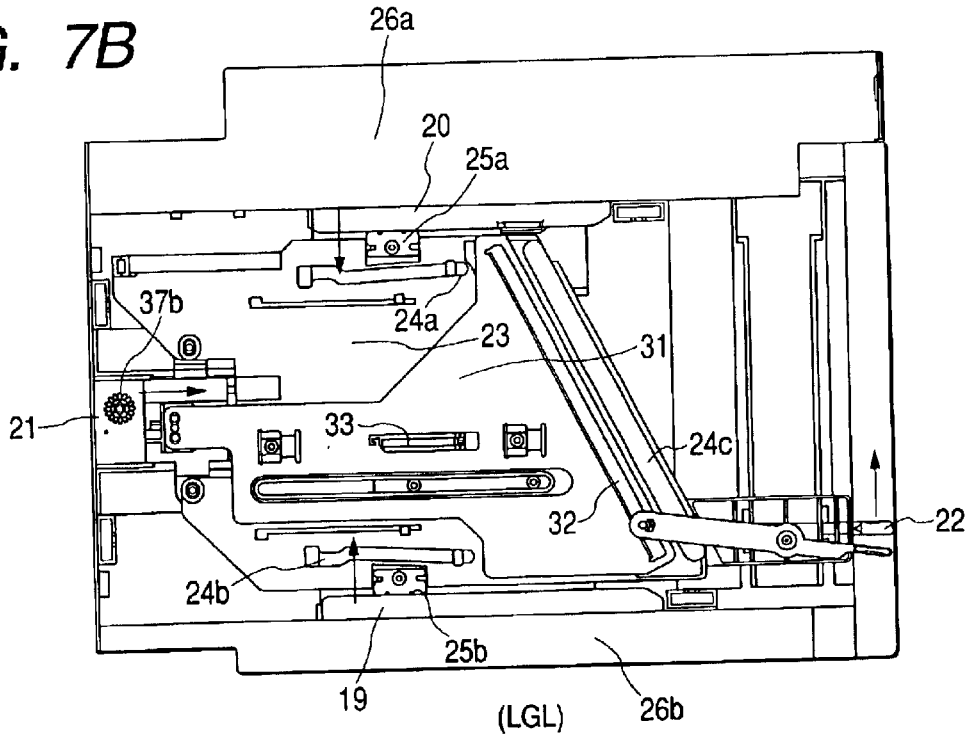

Here, if a user wishes to stack sheets of the A4 size, the user moves the operation lever 22 in the direction indicated by the arrow "a" to a position of A4 shown in FIG. 7A. Then, when the operation lever 22 is moved in this manner, the trailing end regulating member 21 moves in the direction indicated by the arrow "b" in FIG. 5 by the board member 23. Further, an amount of movement of the trailing end regulating member 21 is approximately 17.6 mm. When the trailing end regulating member 21 moves in this manner, if sheets of the A4 size is stacked, a leading end of the sheets is positioned in the sheet feeding position.

When the operation lever 22 is moved in the direction indicated by the arrow "a" in this manner, the two side regulating members 19 and 20 move to a position according to the shape of the slits 24*a* and 24*b* provided in the board member 23. Further, if the sheet size is set as the A4 size in this manner, both the two side regulating members 19 and 20 move to the inside by approximately 3 mm from the LTR position, and the distance between the side regulating members is changed to approximately 210 mm.

Incidentally, when the board member 23 moves by such an operation of the operation lever 22, the arm members 25*a* and 25*b* attached to the board member 23 move along the frames 26*a* and 26*b* and the side regulating members 19 and 20.

Here, in the A4 position shown in FIG. 6B, the ribs 27 provided in the side regulating members 19 and 20 are offset by 3 mm from the position of the LTR size in the same manner as the shape of the slits 24*b* and 24*a* of the board member 23 below them (see FIG. 7A) changes. Thus, even when the side regulating members 19 and 20 moves to the inside by approximately 3 mm, the arm members 25*a* and 25*b* abut against the projected stepped portions of the ribs 27 provided in the side regulating members 19 and 20. Further, at this point, the other sides of the arm members 25*a* and 25*b* are always in contact with the device frames 26*a* and 26*b*.

Consequently, deflection to the back surface side of each of the side regulating members 19 and 20 is regulated by the device frames 26*a* and 26*b* via the arm members 25*a* and 25*b*. Thus, when sheets S are inserted, even if the side regulating members 19 and 20 are pushed by the weight of the sheets S, each of the side regulating members 19 and 20 does not deflect and sheets of the A4 size can be stacked accurately.

In changing the sheet size from the A4 size to the LGL size, the operation lever 22 is operated in a direction indicated by the arrow "e" in FIG. 7A to move from the position of the A4 size to the position of the LGL size. Then, by such an operation of the operation lever 22, the trailing end regulating member 21 moves by 58.6 mm and each of the side regulating members 19 and 20 move to the outside by 3 mm.

Then, even when each of the side regulating members 19 and 20 are moved in this manner, for example, since the arm member 25*a* abuts against the rib 27 of the non-reference-side side regulating member 20 as shown in FIG. 6C, the non-reference-side regulating member 20 is prevented from being deflected by the weight of the sheets S. Consequently, the sheets of the LGL size can be accurately positioned and stacked.

In this way, the rib 27 having the stepped portions in the horizontal direction is provided on the back surface of each of the side regulating members 19 and 20, and the rib 27 is constituted so as to abut against the arm member 25*a* or 25*b* in association with the movement of each of the side regulating members 19 and 20. Thus, each of the side regulating members 19 and 20 can be prevented from being deflected by the weight of sheets. Consequently, accurate positioning of stacked sheets becomes possible. Further, if the arm members 25*a* and 25*b* are formed of a material with high rigidity, deflection of each of the side regulating members 19 and 20 can be prevented only by the arm members 25*a* and 25*b*.

Next, a second embodiment of the present invention will be described.

Figure 8:
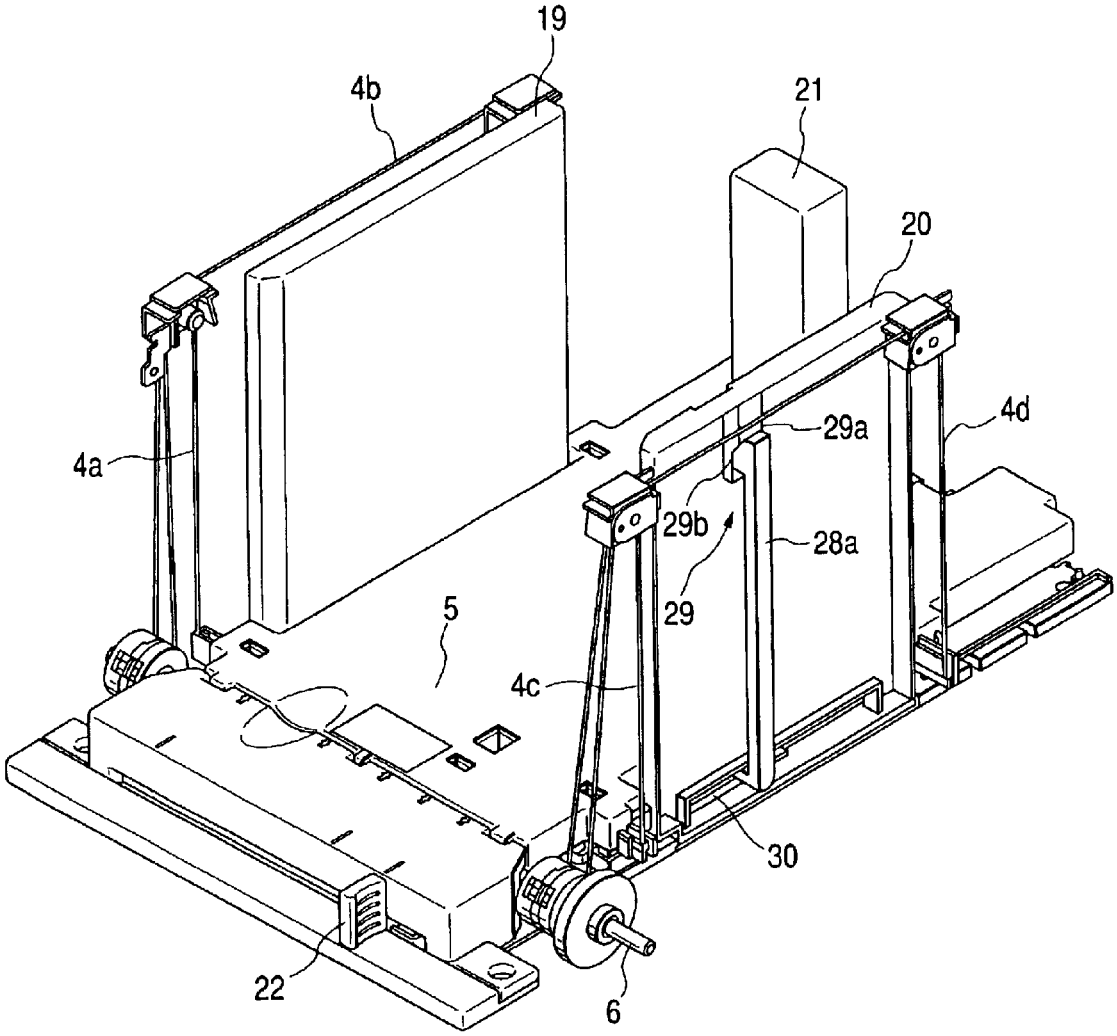
FIG. 8 is a perspective view showing a structure of a sheet containing device provided in a sheet feeder in accordance with a second embodiment of the present invention.

FIG. 8 is a perspective view showing a structure of a sheet containing device provided in a feed deck in accordance with this embodiment. Note that, in FIG. 8, the reference numerals identical with those in FIG. 2 indicate identical or equivalent portions, and detailed descriptions of such portions will be omitted.

In FIG. 8, reference numeral 28*a* denotes an arm member moving between the non-reference-side side regulating member 20 and the device frame 26*a*. This arm member 28*a* is provided so as to be capable of ascending and descending while abutting against the board member 23 with the aid of gravity. Reference numeral 30 denotes a projection provided on a surface of the board member 23 abutting against the arm member 28*a*. In changing a sheet size, when the board member 23 is moved, the arm member 28*a* ascends and descends by this projection 30.

In addition, reference numeral 29 denotes a projected shape portion that constitutes an abutting portion provided in the upper part on the back surface of the non-reference-side side regulating member 20. This projected shape portion 29 has two steps having different projection amounts (stepped portions) in the upper and lower steps. Note that, in this embodiment, a difference between an upper step projection 29*a* and a lower step projection 29*b* is approximately 3 mm. In addition, an arm member of the same structure (not shown) is provided between the reference-side side regulating member 19 and the device frame 26*b*.

Next, operations of the three regulating members 19, 20 and 21 and the arm member 28 in changing stacked sheets will be described. Here, operations for changing sheets from the LTR size to the A4 size and the LGL size will be described.

Figure 9A:
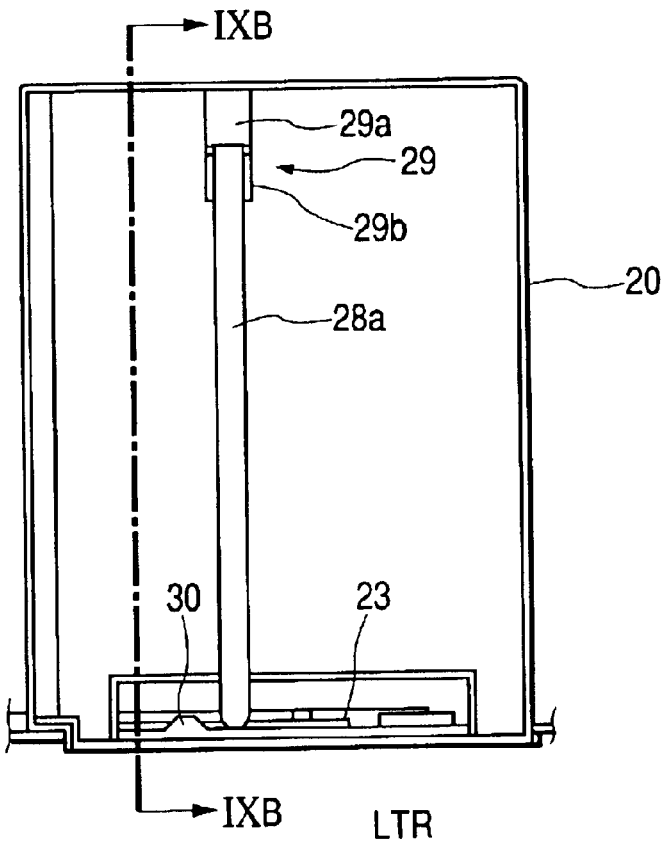
FIG. 9A is a side view showing a structure of the sheet containing device shown in FIG. 8.
Figure 9B:
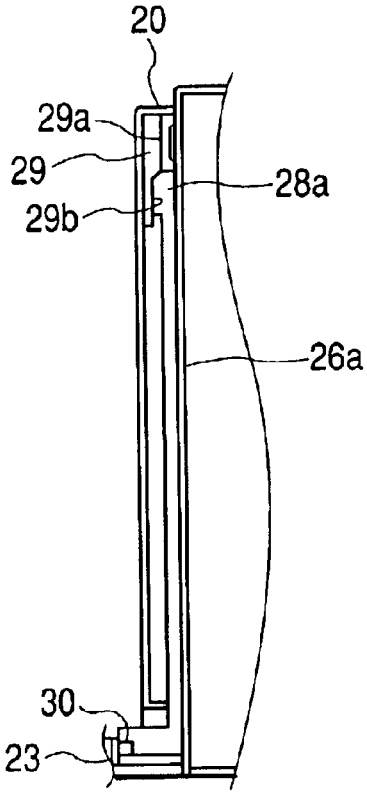
FIG. 9B is a sectional view taken along a line IXB—IXB of FIG. 9A.

FIGS. 9A and 9B show the positions of the three regulating members 19, 20 and 21 at the time when sheets of the LTR size are stacked. If the sheet size is changed from this state to the A4 size, the board member 23 moves by approximately 17.6 mm as in the first embodiment. In addition, the side regulating member 20 moves after the slit 24*a* provided in the board member 23 to the inside by 3 mm as in the first embodiment.

Figure 10A:
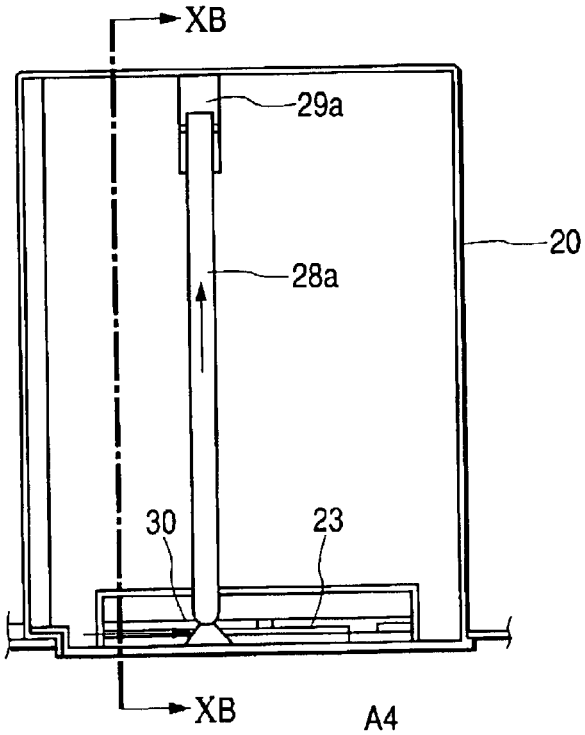
FIGS. 10A and 10C are side views showing states at the time of changing a sheet size of the sheet containing device shown in FIG. 8.
Figure 10B:
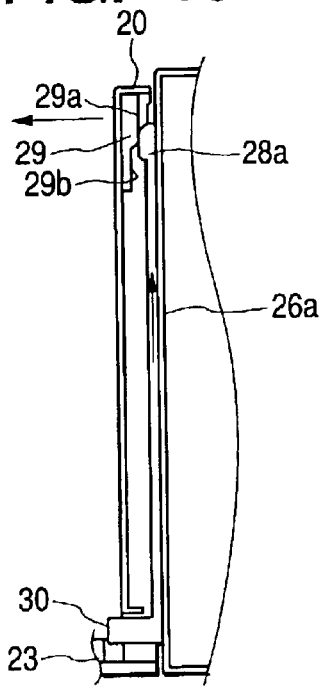
FIGS. 10B and 10D are sectional views taken along a line XB—XB and a line XD—XD of FIGS. 10A and 10C.

Then, when the board member 23 moves in this manner, the projection 30 provided in the board member 23 moves to a position below the arm member 28*a* as shown in FIGS. 10A and 10B, whereby the arm member 28*a* moves upward. Here, when the arm member 28*a* moves upward in this manner, an upper end of the arm member 28*a* abuts against the upper step projection 29*a* of the projected shape portion 29 provided in the non-reference-side side regulating member 20.

Consequently, deflection to the back side of the non-reference-side side regulating member 20 is regulated by the device frame 26*a* via the arm member 28*a*. Thus, when sheets S are inserted, even if the non-reference-side side regulating member 20 is pushed by the weight of the sheets S, the non-reference-side side regulating member 20 is not deflected and sheets of the A4 size can be stacked accurately. Note that this operation is the same in the reference-side side regulating member 19.

Figure 10C:
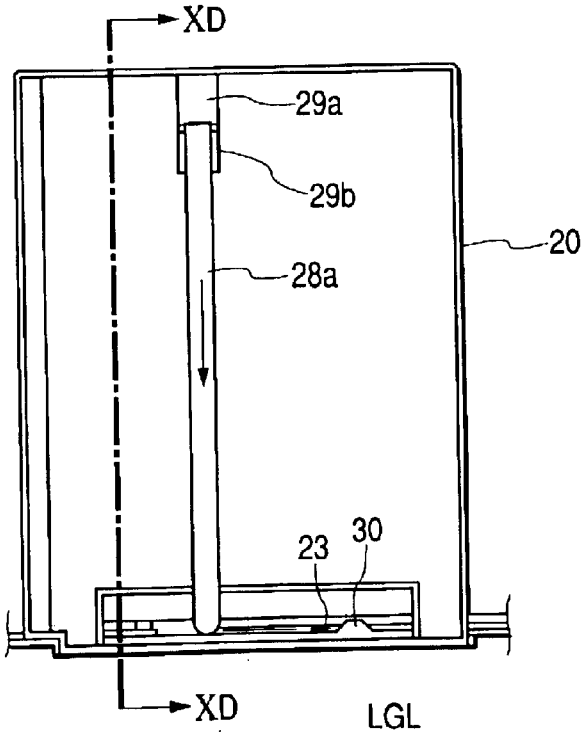
Figure 10D:
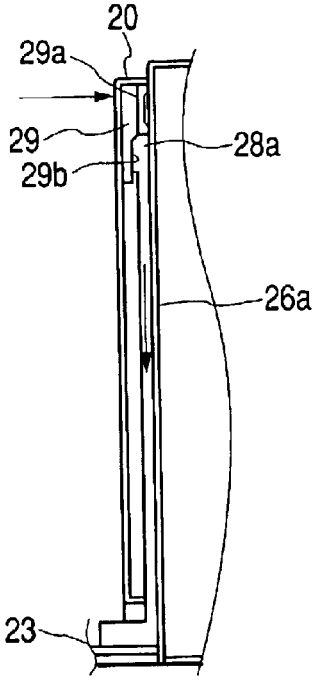

In changing the sheet size from the A4 size to the LGL size, the board member 23 moves by the operation of the operation lever 22, and with this movement, the projection 30 provided in the board member 23 comes off the arm member 28*a* as shown in FIGS. 10C and 10D. Consequently, the arm member 28*a* descends with the aid of gravity. Then, when the arm member 28*a* descends in this way, the upper side of the arm member 28*a* abuts against the lower step projection 29*b* of the projected shape portion 29 provided in the reference-side side regulating member 20. Thus, deflection to the back surface side of the non-reference-side side regulating member 20 can be regulated by the device frame 26*a* via the arm member 28*a* in a position offset by 3 mm from the A4 size as in the case of the LTR size.

In this way, the projected shape portion 29 having the stepped portions in the vertical direction is provided on the back surface of each of the side regulating members 19 and 20, and the projected shape portion 29 is constituted so as to abut against the arm member 28*a* that moves in association with the movement of each of the side regulating members 19 and 20. Thus, each of the side regulating members 19 and 20 is prevented from being deflected due to a weight of sheets, or the like. Consequently, accurate positioning of stacked sheets becomes possible.

Next, a third embodiment of the present invention will be described.

Figure 11:
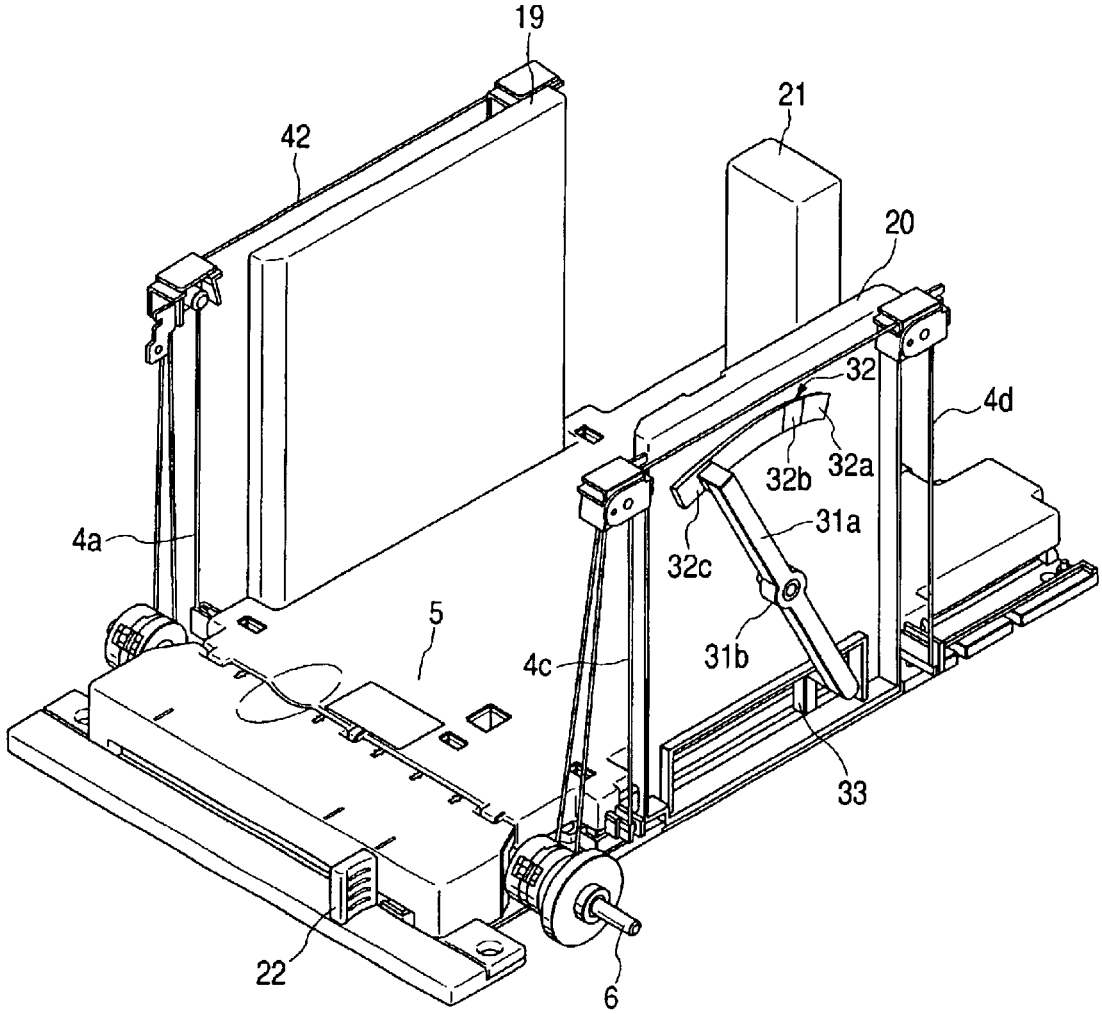
FIG. 11 is a perspective view showing a structure of a sheet containing device provided in a sheet feeder in accordance with a third embodiment of the present invention.

FIG. 11 is a perspective view showing a structure of a sheet containing device provided in a feed deck in accordance with this embodiment. Note that, in FIG. 11, the reference numerals identical with those in FIG. 2 indicate identical or equivalent portions.

In FIG. 11, reference numeral 31*a* denotes an arm member moving between the non-reference-side side regulating member 20 and the device frame 26*a*. This arm member 31*a* is rotatably connected to a shaft 31*b* provided on each of the side regulating members 19 and 20. In addition, reference numeral 32 denotes a projected shape portion of an arc shape provided in the upper part on the back surface of the non-reference-side side regulating member 20. This projected shape portion 32 is a stepped portion having two steps in which a central part 32*b* is more projected than both end parts 32*a* and 32*c*. In this embodiment, a difference of projection amounts of the central part 32*b* and both the left and right end parts 32*a* and 32*c* is approximately 3 mm.

Here, an engaging portion 33 engaging with the arm member 31*a* is provided in the board member 23. The arm member 31*a* rotates about the shaft 31*b* with the movement of the board member 23. In addition, an arm member of the same structure (not shown) is provided between the reference-side side regulating member 19 and the device frame 26*b*.

Next, operations of the three regulating members 19, 20 and 21 and the arm member 31*a* in changing stacked sheets will be described. Here, operations for changing sheets from the LTR size to the A4 size and the LGL size will be described.

Figure 12A:
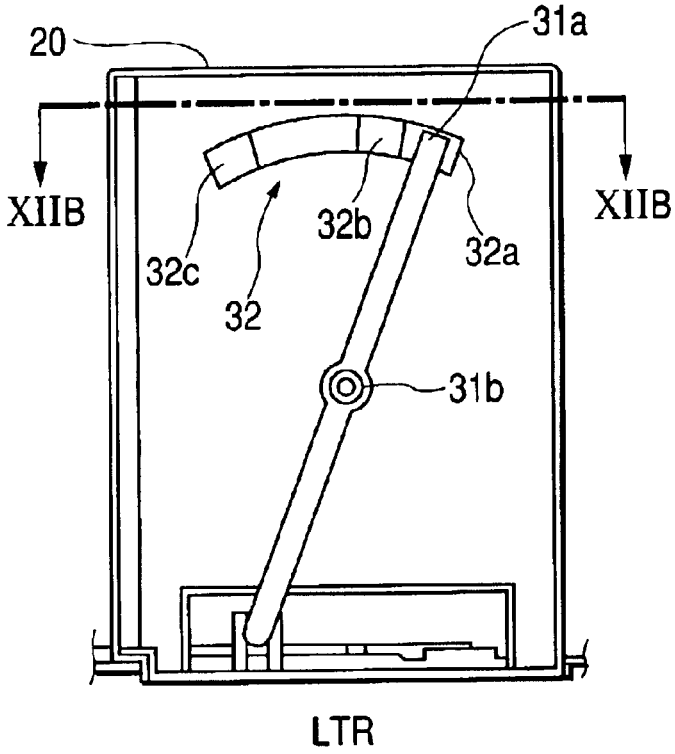
FIG. 12A is a side view showing a structure of the sheet containing device shown in FIG. 11.
Figure 12B:
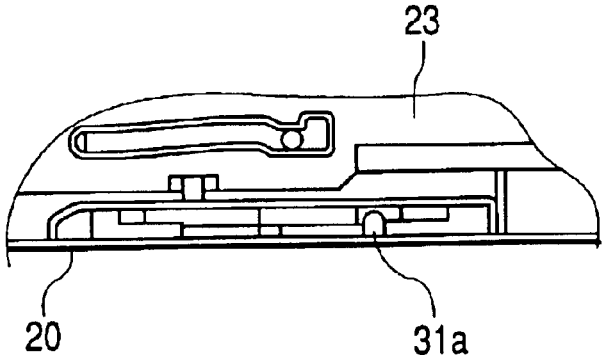
FIG. 12B is a sectional view taken along a line XIIB—XIIB of FIG. 12A.

FIGS. 12A and 12B show the positions of the three regulating members 19, 20 and 21 at the time when sheets of the LTR size are stacked. If the sheet size is changed from this state to the A4 size, the board member 23 moves by approximately 17.6 mm as in the first embodiment. In addition, the side regulating member 20 moves after the slit provided in the board member 23 to the inside by 3 mm as in the first embodiment.

Figure 13A:
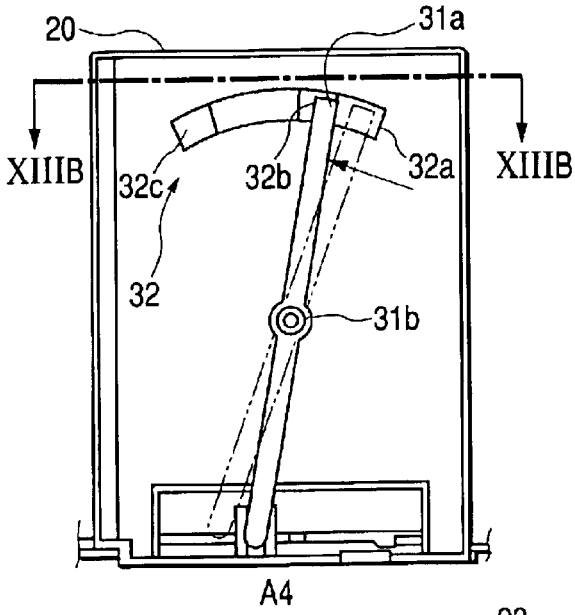
FIGS. 13A and 13C are side views showing states at the time of changing a sheet size of the sheet containing device shown in FIG. 11.
Figure 13B:
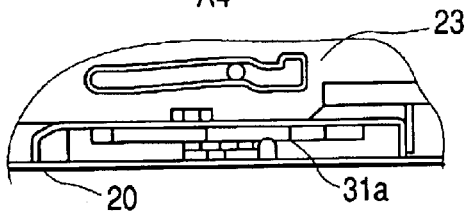
FIGS. 13B and 13D are sectional views taken along a line XIIIB—XIIIB and a line XIIID—XIIID of FIGS. 13A and 13C.

Then, when the board member 23 moves in this manner, the arm member 31*a* rotates in a direction indicated by the arrow in FIG. 13A with the movement of the board member 23, and the upper end of the arm member 31*a* moves so as to abut against the central part 32*b* from the end part 32*a* of the arc-shaped projected shape portion 32 provided in the non-reference-side side regulating member 20.

Consequently, deflection to the back surface side of the non-reference-side side regulating member 20 is regulated by the device frame 26*a* via the arm member 31*a*. Thus, when sheets S are inserted, even if the non-reference-side side regulating member 20 is pushed by the weight of the sheets S, the non-reference-side side regulating member 20 is not deflected and sheets of the A4 size can be stacked accurately. Note that this operation is the same in the reference-side side regulating member 19.

Figure 13C:
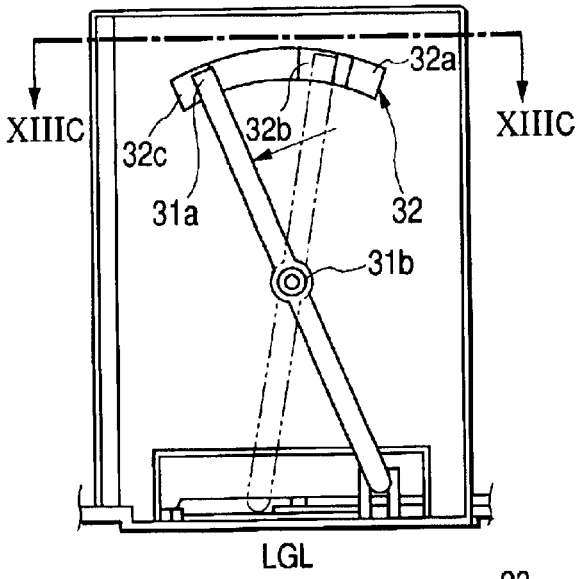
Figure 13D:
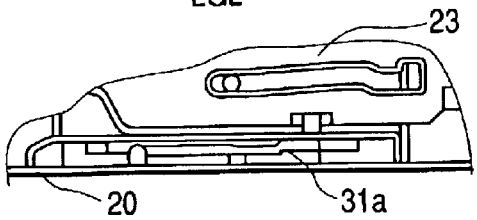

In changing the sheet size from the A4 size to the LGL size, the board member 23 moves by the operation of the operation lever 22. Consequently, the arm member 31*a* rotates to the position shown in FIGS. 13C and 13D. Then, when the arm member 31*a* rotates in this manner, the upper side of the arm member 31*a* abuts against the end part 32*c* of the projected shape portion 32 provided in the reference-side side regulating member 20. Thus, deflection to the back surface side of the non-reference-side side regulating member 20 can be regulated by the device frame 26*a* via the arm member 31*a* in a position offset by 3 mm from the A4 size as in the case of the LTR size.

In this way, the arc-shaped projected shape portion 32 having the stepped portions is provided on the back surface of each of the side regulating members 19 and 20, and the projected shape portion 32 is constituted so as to abut against the arm member 31*a* that moves in association with the movement of each of the side regulating members 19 and 20. Thus, each of the side regulating members 19 and 20 is prevented from being deflected due to a weight of sheets, or the like. Consequently, accurate positioning of stacked sheets becomes possible.

Further, in each of the above-mentioned embodiments, the arm members 25*a* (25*b*), 28*a* (28*b*), and 31*a* (31*b*) are moved along the device frames 26*a* and 26*b* in the horizontal direction, in the vertical direction and in the rotation direction, respectively, and the ribs 27, the projected shaped portion 29 and the projected shaped portion 32 are provided in the side regulating members 19 and 20 that abut against the arm members. However, conversely, the arm members 25*a* (25*b*), 28*a* (28*b*), and 31*a* (31*b*) may be moved along the side regulating members 19 and 20 in the horizontal direction, in the vertical direction and in the rotation direction, respectively, and the ribs 27, the projected shaped portion 29 and the projected shaped portion 32 that abut against the arm members may be provided in the device frames 26*a* and 26*b*.

What is claimed is:

1. A sheet containing device comprising:

a device frame;

sheet stacking means, provided in said device frame, for supporting a sheet;

end regulating means movable in a direction crossing a moving direction of the sheet for abutting against an end of the sheet stacked on said sheet stacking means to perform positional regulation of the sheet;

arm means arranged between said device frame and said end regulating means, said arm means being moved in accordance with a movement of said end regulating means; and abutting means abutting on said arm means in a position to which said arm means moves, wherein said arm means is in contact with said device frame so that a deflection of said end regulating means is restricted by said device frame through said arm means and said abutting means.

2. A sheet containing device according to claim 1, wherein said arm means is provided between said device frame and said end regulating means and movable along said device frame and said end regulating means, and said abutting means has stepped portions with different heights for abutting different stepped portions of said abutting means against said arm means according to a moved position of said arm means, thereby restricting deflection of said end regulating means.

3. A sheet containing device according to claim 2, wherein said arm means is slidably provided in said device frame, and said abutting means which has said stepped portions are provided in said end regulating means.

4. A sheet containing device comprising:

a sheet stacking table for supporting a sheet;

a side regulating member movable in a cross direction of the sheet perpendicular to a sheet feeding direction of the sheet stacked on said sheet stacking table for abutting against a side end of the sheet stacked on said sheet stacking table to perform positional regulation in the cross direction of the sheet;

an arm member for abutting against a back surface opposite to a sheet abutting surface of said side regulating member to restrict deflection to a back surface side of said side regulating member;

a connecting member for moving said arm member in a direction intersecting a moving direction of said side regulating member in association with a moving operation of said side regulating member; and an abutting portion that is provided on the back surface of said side regulating member and is formed in a shape for abutting against said arm member moved by said connecting member in a position to which said side regulating member moves to regulate the sheet.

5. A sheet containing device according to claim 4, wherein said connecting member moves said arm member in the sheet feeding direction in association with the moving operation of said side regulating member, and said abutting portion has a stepped portion provided in a horizontal direction so that said stepped portion abuts against said arm member moved in the sheet feeding direction even if said side regulating member moves.

6. A sheet containing device according to claim 4, wherein said connecting member lifts and lowers said arm member in association with the moving operation of said side regulating member, and said abutting portion has a stepped portion provided in a vertical direction so that said stepped portion abuts against said arm member lifted and lowered even if said side regulating member moves.

7. A sheet containing device according to claim 4, wherein said connecting member rotates said arm member in association with the moving operation of said side regulating member, and said abutting portion has an arc-shaped stepped portion so that said arc-shaped stepped portion abuts against said arm member rotated even if said side regulating member moves.

8. A sheet containing device according to claim 4, wherein said abutting portion is provided at least in an upper part on the back surface of said side regulating member.

9. A sheet containing device according to claim 4, wherein said arm member is arranged between said side regulating member and a device frame, and deflection of said side regulating member is restricted by said device frame through said arm member.

10. A sheet containing device according to claim 4, wherein said side regulating member is provided in each of a left side and a right side in the cross direction of the sheet, and said connecting member moves said left and right side regulating members in association with each other.

11. A sheet containing device according to claim 4, further comprising a trailing end regulating member for abutting against a trailing end opposite to the sheet feeding direction of the sheet stacked on said sheet stacking table to perform positional regulation of the sheet in the sheet feeding direction, wherein said trailing end regulating member is moved in association with the moving operation of said side regulating member through said connecting member.

12. A sheet feeder comprising:

a sheet stacking table for supporting a sheet;

a side regulating member movable in a cross direction of the sheet perpendicular to a sheet feeding direction of the sheet stacked on said sheet stacking table for abutting a side end of the sheet stacked on said sheet staking table to perform positional regulation in the cross direction of the sheet;

an arm member for abutting against a back surface opposite to a sheet abutting surface of said side regulating member to restrict deflection to a back surface side of said side regulating member;

a connecting member for moving said arm member in a direction intersecting a moving direction of said side regulating member in association with a moving operation of said side regulating member;

an abutting portion that is provided on the back surface of said side regulating member and is formed in a shape for abutting against said arm member moved by said connecting member in a position to which said side regulating member moves to regulate the sheet; and a feed roller for feeding out the sheet that is stacked on said sheet stacking table and is regulated by said side regulating member.

13. An image forming apparatus comprising:

a sheet stacking table for supporting a sheet;

a side regulating member movable in a cross direction of the sheet perpendicular to a sheet feeding direction of the sheet stacked on said sheet stacking table for abutting against a side end of the sheet stacked on said sheet stacking table to perform positional regulation in the cross direction of the sheet;

an arm member for abutting against a back surface opposite to a sheet abutting surface of said side regulating member to restrict deflection to a back surface side of said side regulating member;

a connecting member for moving said arm member in a direction intersecting a moving direction of said side regulating member in association with a moving operation of said side regulating member;

an abutting portion that is provided on the back surface of said side regulating member and is formed in a shape for abutting against said arm member moved by said connecting member in a position to which said side regulating member moves to regulate the sheet;

a feed roller for feeding out the sheet that is stacked on said sheet stacking table and is regulated by said side regulating member; and an image forming portion for forming an image on the sheet fed out by said feed roller.

* * * * *

UNITED STATES PATENT AND TRADEMARK OFFICE

CERTIFICATE OF CORRECTION

PATENT NO. : 6,830,245 B2
DATED : December 14, 2004
INVENTOR(S) : Akira Matsushima et al.

It is certified that error appears in the above-identified patent and that said Letters Patent is hereby corrected as shown below:

Column 1,
Line 21, “staking” should read -- stacking --.

Column 5,
Line 12, “staking” should read -- stacking --.

Column 6,
Line 40, “member” should read -- members 19 and --.
Line 43, “side” should read -- non-reference-side side --.
Line 48, “do not” should read -- are not --.

Column 7,
Line 8, “is stacked,” should read -- are stacked --.
Line 29, “moves” should read -- move --.
Line 56, “regulating” should read -- side regulating --.

Column 8,
Line 44, “side” should read -- non-reference-side side --.

Column 9,
Line 8, “reference-side” should read -- non-reference-side --.

Column 10,
Line 19, “projected” should read -- arc-shaped projected --, and “reference-side” should read -- non-reference-side --.
Lines 28, 40 and 47, “projected” should read -- arc-shaped projected --

UNITED STATES PATENT AND TRADEMARK OFFICE

CERTIFICATE OF CORRECTION

PATENT NO. : 6,830,245 B2
DATED : December 14, 2004
INVENTOR(S) : Akira Matsushima et al.

It is certified that error appears in the above-identified patent and that said Letters Patent is hereby corrected as shown below:

Column 12,
Line 20, “staking” should read -- stacking --.

Signed and Sealed this

Tenth Day of May, 2005

JON W. DUDAS
*Director of the United States Patent and Trademark Office*